United States Patent [19]

Nakamura

[11] 4,334,206

[45] Jun. 8, 1982

[54] FERRITE CORE TYPE TRANSFORMER

[75] Inventor: Kenzi Nakamura, Katano, Japan

[73] Assignee: Sanyo Electric Co., Ltd., Osaka, Japan

[21] Appl. No.: 180,392

[22] Filed: Aug. 22, 1980

[30] Foreign Application Priority Data

Aug. 23, 1979 [JP] Japan ..... 54-116504[U]
Sep. 17, 1979 [JP] Japan ..... 54-119688

[51] Int. Cl.[3] ..... H01F 27/30

[52] U.S. Cl. ..... 336/96; 336/178; 336/198; 336/210

[58] Field of Search ..... 336/192, 210, 178, 96, 336/198, 205

[56] References Cited

U.S. PATENT DOCUMENTS 2,882,506 4/1959 Brooks et al. ..... 336/210
4,095,206 6/1978 Hishiki ..... 336/96
4,238,753 12/1980 Bayer ..... 336/178

*Primary Examiner*—Thomas J. Kozma
*Attorney, Agent, or Firm*—Armstrong, Nikaido, Marmelstein & Kubovcik

[57] ABSTRACT

A ferrite core type transformer, such as a flyback transformer used in a television receiver, includes a ferrite core unit and a coil unit mounted on the core unit. The ferrite core unit is constituted by a pair of U-shaped core members which are arranged to assume a figure "O" with a suitable spacer members held between each of the matching ends. A first bonding agent of quick hardening type is applied between the matching ends of the U-shaped core member, and a second bonding agent having resiliency is deposited in a contacting area between the core unit and the coil unit.

7 Claims, 9 Drawing Figures

*Fig. 8*

(Kg)

| Test items \ Test piece | 1 | 2 | 3 | 4 | 5 | Ave |
|---|---|---|---|---|---|---|
| Initial value | 70.0 | 78.0 | 130.0 | 84.0 | 104.0 | 80.70 |
| Thermal durability (at 120°c for 1000 hrs.) | 152.0 | 104.4 | 140.2 | 108.2 | 97.0 | 120.36 |
| Thermal durability (at -40°c for 1000 hrs.) | 76.0 | 84.0 | 76.5 | 51.0 | 69.1 | 71.34 |
| moisture durability (at 40°c, 90% humidity for 1000 hrs.) | 77.2 | 39.8 | 50.5 | 51.7 | 55.2 | 55.88 |
| Thermal durability (alternately at -40°c for 2hrs. and 120°c for 2hrs., repeatedly 20 cycs.) | 95.0 | 136.0 | 57.0 | 130.3 | 87.4 | 101.88 |

*Fig. 9*

(Kg)

| Test items / Test items | 1 | 2 | 3 | 4 | 5 | Ave. |
|---|---|---|---|---|---|---|
| Initial value | above 150 | above 150 | above 150 | above 150 | above 150 | above 150 |
| Thermal durability (at 120°c for 1000hrs.) | same | same | same | same | same | same |
| Thermal durability (at -40°c for 1000hrs.) | same | same | same | same | same | same |
| moisture durability (at 40°c, 90% humidity for 1000hrs.) | same | same | same | same | same | same |
| Thermal durability (alternatety at -40°c for 2hrs. and 120°c for 2hrs., repeatedly 20 cycs.) | same | same | same | same | same | same |

FERRITE CORE TYPE TRANSFORMER

The present invention relates to a transformer and, more particularly, to a ferrite core type transformer, such as a flyback, or sweep, transformer, for use in a television receiver.

One conventional flyback transformer is shown in FIG. 1. This conventional flyback transformer comprises a pair of U-shaped ferrite cores 2 and 3 which are so disposed as to assume the shape of a figure "O", and a pair of spacers 4 and 5 which are held between the cores 2 and 3. To hold the U-shaped ferrite cores 2 and 3 tightly together in the shape of O, a frame unit constituted by a U-shaped bar 6 and a support plate 7 is provided around the cores 2 and 3. In the example shown in FIG. 1, the opposite ends of the bar 6, which are threaded, are inserted into respective openings formed in the plate 7 and are rigidly connected to the plate 7 by means of nuts 8*a* and 8*b*. A coaxial coil unit 1 constituted by one or more sets of primary and secondary windings installed in a casing is mounted on the cores 2 and 3 arranged in the shape of O.

According to the above arrangement, it has been found that, when the transformer is in use, the capacitance developed between the core 2, 3 and frame unit may result in an undesirable increase of potential in the cores 2 and 3 with respect to the frame unit. When the discharge of the potential takes places by means of a spark between the core 2, 3 and the frame unit, the discharge deteriorates an image being reproduced on the screen of the television receiver. In addition, the spark may produce ozone which deteriorates the insulating material incorporated in the television receiver.

Furthermore, according to the conventional flyback transformer, the peripheral surface of the cores 2 and 3, which contacts the bar 6 is formed with a groove for positioning the bar 6. Therefore, the conventional flyback transformer has such disadvantages that unwanted ozone is likely to be generated and that it requires the use of an increased number of constructing components and manufacturing steps.

Another conventional flyback transformer is disclosed in U.S. Pat. No. 3,533,036 to Frank A. Wood, titled "Television Sweep Transformer" and issued on Oct. 6, 1970. Yet another conventional flyback transformer is disclosed in Japanese Pat. No. 40686/1978 to Junichi Iwazawa, titled "Flyback transformer" and published on Oct. 28, 1978.

It is a primary object of the present invention to provide a ferrite core type transformer which, when in use, will not produce any discharge.

It is a further object of the present invention to provide a ferrite core type transformer of the above described type which is simple in construction and can readily be manufactured at low cost.

In accomplishing these and other objects, a ferrite core type transformer according to the present invention comprises a ferrite core unit and a coil unit mounted on the ferrite core unit. The ferrite core unit comprises a first core member having first and second end faces, a second core member having first and second end faces which, when the first and second core members are held together, match with the first and second end faces of the first core member, first and second spacer means positioned between the first end faces of the first and second core members, and between the second end faces of the first and second core members, respectively, and a first bonding agent of a quick hardening acrylic type applied around the first and second spacer means to rigidly connect the first and second core members together through the first and second spacer members. The coil unit has a bore formed therethrough for receiving a portion of the core unit and guide means for receiving a portion of the core unit which extends outwardly from the bore. A second bonding agent having a resiliency is deposited in the guide means for securing the connection between the coil unit and the core unit.

According to a preferred embodiment of the present invention, a holder means for holding the first and second core members together at a portion where the first and second core members match is provided. The holder means has a base portion and bifurcated arms extending from the base portion. The holder means is curved to locate the bifurcated arms in a face-to-face relation with the base portion, whereby a portion of the base portion and one of the bifurcated arms hold a portion of the first core member adjacent its first end face, and a portion of the base portion and the other of the bifurcated arms hold a portion of the second core member adjacent its second end face by the resiliency of the holder means.

These and other objects and features of the present invention will become apparent from the following description taken in conjunction with a preferred embodiment thereof with reference to the accompanying drawings, throughout which like parts are designated by like reference numerals, and in which:

FIGS. 8 and 9 are charts showing a durability of the flyback transformer of the present invention obtained by a breakdown test.

Figure 1:
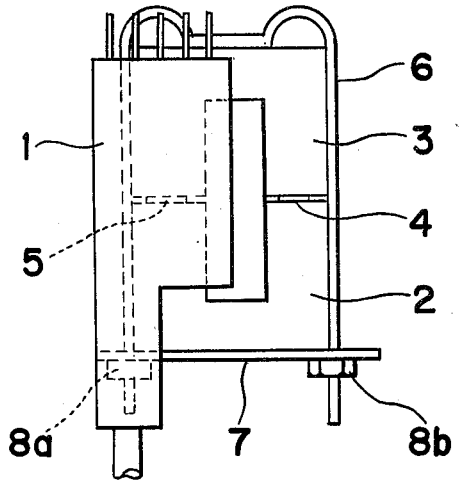
Fig. 1 Prior Art
FIG. 1 is a side view of a flyback transformer of one conventional type.
Figure 2:
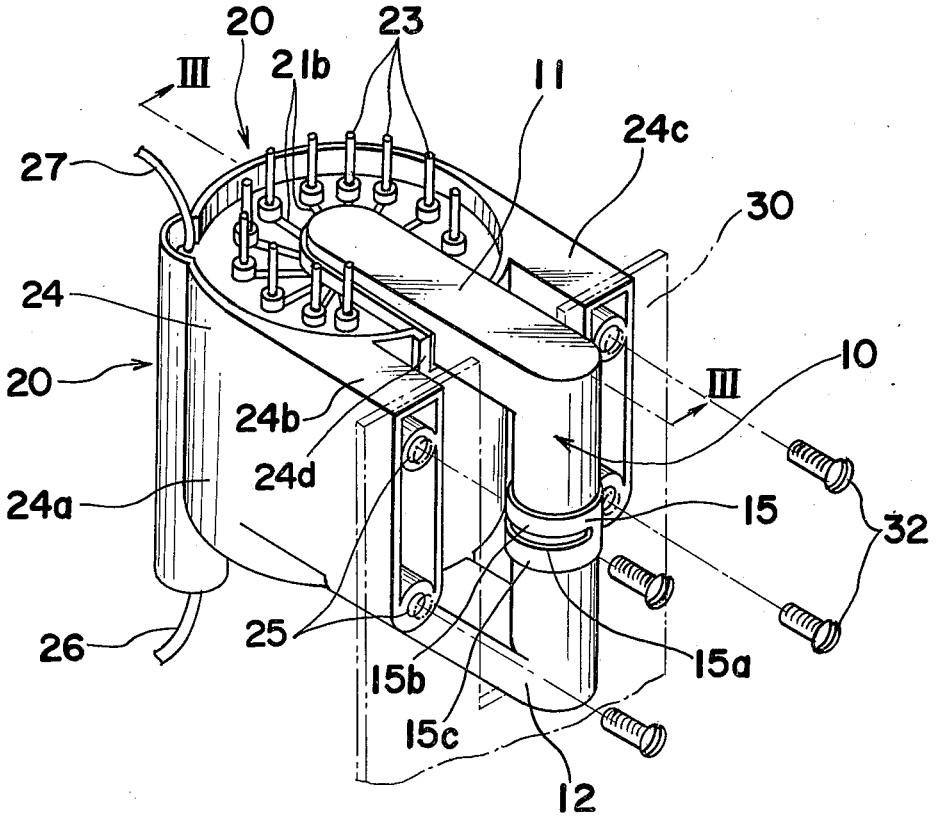
FIG. 2 is a perspective view of a flyback transformer of the present invention.
Figure 3:
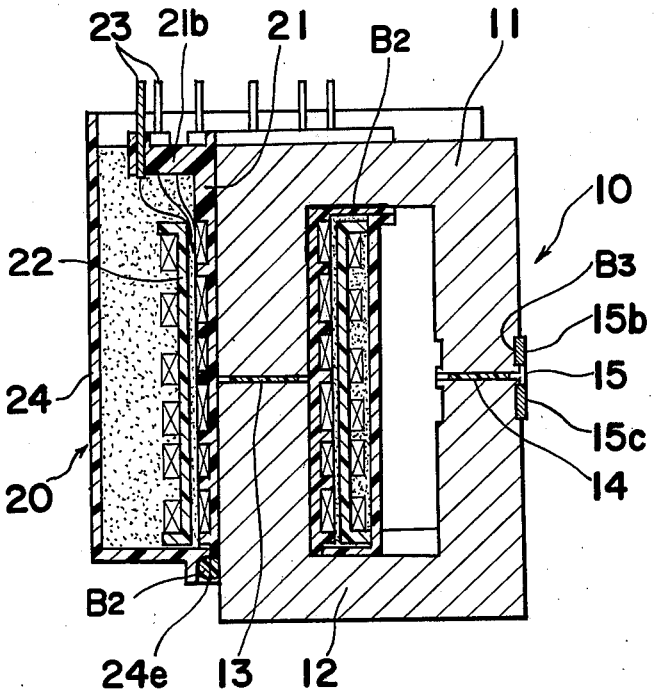
FIG. 3 is a cross-sectional view taken along a line III—III shown in FIG. 2.

Referring to FIGS. 2 and 3, a flyback transformer of the present invention comprises a core unit 10 arranged generally in the shape of a figure "O", and a coaxial coil unit 20 mounted on the core unit 10.

Figure 6:
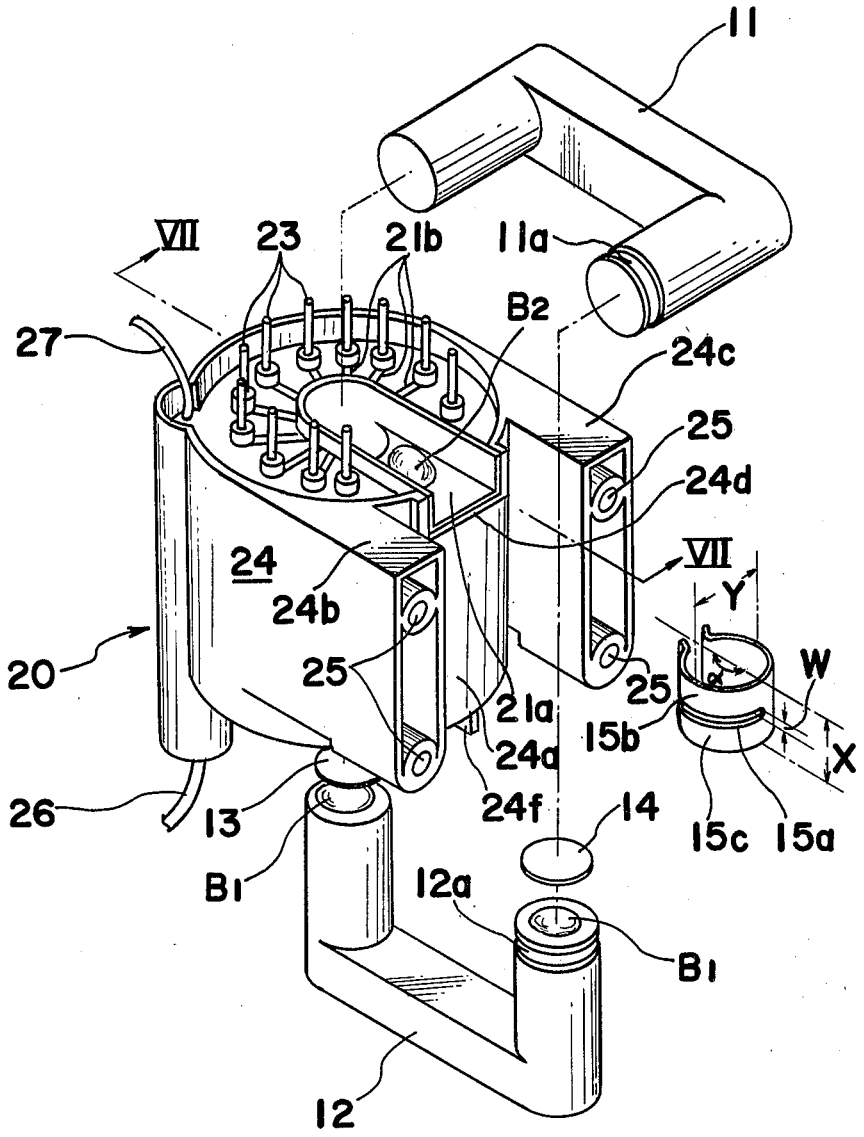
FIG. 6 is an exploded view of the flyback transformer of FIG. 2.

The core unit 10 consists of a pair of generally U-shaped members 11 and 12, each made of ferrite and having a pair of parallelly extending leg portions and a bridge portion which is so extending between the respective ends of the leg portion as to render the corresponding core member 11 or 12 to assume the shape of figure "U". A pair of spacers 13 and 14 made of non-magnetic material, such as a nylon 11 or Rilsan (registered trademark of RILSAN CORPORATION U.S.A.), are rigidly held between the U-shaped members 11 and 12 by means of bonding agent. The type of bonding agent and the method of applying the bonding agent are described in detail later. A holder ring 15 made of material with high resiliency, such as, stainless steel, phosphor bronze, nylon, Duracon, vinyl chloride, FR-PET, PBT, etc., is applied to a section of core unit 10 where the U-shaped members meet outside the coaxial coil unit 20. The holder ring 15 has a horseshoe shape cross-section with a slit 15*a* formed about a half-way along its circumference to provide bifurcated arms 15*b* and 15*c*. The arm 15*b* rigidly holds the end portion of the U-shaped member 11 while the arm 15*c* rigidly holds the end portion of the U-shaped member 12. To effect a further rigid contact between the holder 15 and the respective U-shaped members 11 and 12, the end portion of the leg portions of the U-shaped members 11 and 12 which contact the holder ring 15 are formed with grooves 11*a* and 12*a*, respectively. According to a preferred embodiment, the size of the holder ring 15 is such that its inner diameter Y (FIG. 6) is 1 to 2 mm smaller than the outer diameter of the leg portion of the respective U-shaped members 11 and 12 (if the U-shaped members 11 and 12 are formed with grooves 11*a* and 12*a*, the inner diameter Y is 1 to 2 mm smaller than the diameter of the grooved portion); the height X is 15 mm±5 mm; the angle $\alpha$ of the slit 15*a* is 180°±20°; and the width W of the slit 15*a* is 2 mm±1 mm. Furthermore, the ends of the bifurcated arms 15*b* and 15*c* and the nonbifurcated end of the ring 15 should be curved outwardly, as best shown in FIG. 6, to facilitate the mounting action of the ring 15 onto the core unit 10.

Although it is possible to use a holder ring without a slit formed therein, such a holder ring may not hold the core members as fast as that formed with the groove. For example, if there is any difference in the size, e.g., diameter, between the two core members, the holder ring without the slit only holds the core member having a larger diameter. On the contrary, since the holder ring 15 employed in the flyback transformer of the present invention has bifurcated arms 15*b* and 15*c*, the core members can be tightly held by the holder ring 15, even when the diameter of the core members differs from each other.

The coaxial unit 20 includes an inner bobbin 21 (FIG. 3) made of synthetic resin and having a cylindrical body with a bore formed therethrough and a gutter 21*a* (FIG. 6) extending radially outwards from one end of the cylindrical body. An outer bobbin 22, also made of synthetic resin, is coaxially mounted on the inner bobbin 21. A number of coils are wound on the inner and outer bobbins 21 and 22, in which some coils are connected to a plurality of, such as ten as shown in the embodiment, terminal pins 23 mounted in arms 21*b* radially extending from the end of the inner bobbin 21 provided with the gutter 21*a*. Other coils are connected to a lead wire 26 which is further connected to a screen of a cathode ray tube (not shown) and also to a lead wire 27 which is further connected to a focus control circuit (not shown).

Figure 5:
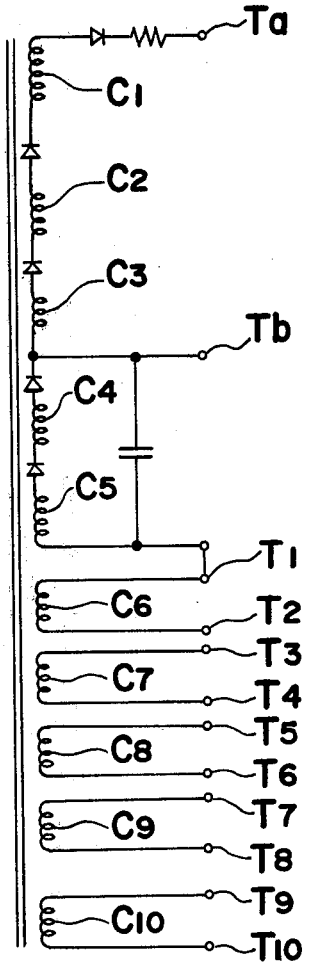
FIG. 5 is a circuit diagram showing one example of an arrangement of coils employed in the flyback transformer of the present invention.

FIG. 5 shows a circuit diagram of the coils constituting the flyback transformer of the embodiment shown. Five windings C1 to C5 connected in series with a diode inserted between the two neighboring coils are wound on the outer bobbin 22, while five separate coils C6 to C10 are wound on the inner bobbin 21. Terminals Ta and Tb are connected to the lead wires 26 and 27, respectively, while the terminals T1 to T10 are connected to the ten terminal pins 23. The coils C6 to C10 are provided to supply voltage to a blanking control circuit (not shown), video control circuit (not shown), heater circuit (not shown), and detection circuit (not shown, described in detail in U.S. patent application of Toshio Takeichi Ser. No. 101,433 filed Dec. 10, 1979, titled "Flyback transformer" and assigned to the same assignee as the present case). Since the number of coils to be wound on the bobbin 21 and the purpose for such wound coils depend on the type of television receiver, a further description therefor is omitted.

After the bobbins 21 and 22 are arranged in the above described manner, they are housed in a casing 24 made of synthetic resin. The casing 24 is formed by a hollow cylindrical body 24*a* and a pair of wings 24*b* and 24*c* extending parallelly to each other from the cylindrical body 24*a*. The wings 24*b* and 24*c* are provided to rigidly install the flyback transformer of the present invention on a support plate 30, as shown by an imaginary line in FIG. 2, by means of screws 32 which can be screwed into threaded openings 25 formed in the respective wings 24*b* and 24*c*. One end of the cylindrical body 24*a* is opened and is formed with a recess 24*d* which receives the gutter 21*a* of the inner bobbin 21, while the other end of the body 24*a* is formed with an opening 24*e* (FIG. 4) which fittingly receives the end portion of the inner bobbin 21 remote from the end provided with the gutter 21*a*. A wall 24*f* (FIG. 4) is provided partly around the opening 24*e*. The wall 24*f* further extends towards the edge of the cylindrical body 24*a* in such a manner as to form a guide groove between the extended walls 24*f*. It is to be noted that the direction in which the guide groove extends corresponds to the direction in which the gutter 21*a* extends.

After the bobbins 21 and 22 are placed in the casing 24, a molten synthetic resin, which can be hardened after a while, is filled into the casing 24 from its open end to secure the bobbins 21 and 22 in the casing 24.

Now, the steps for assembling the core unit 10 and coil unit 20 together is described.

Figure 7:
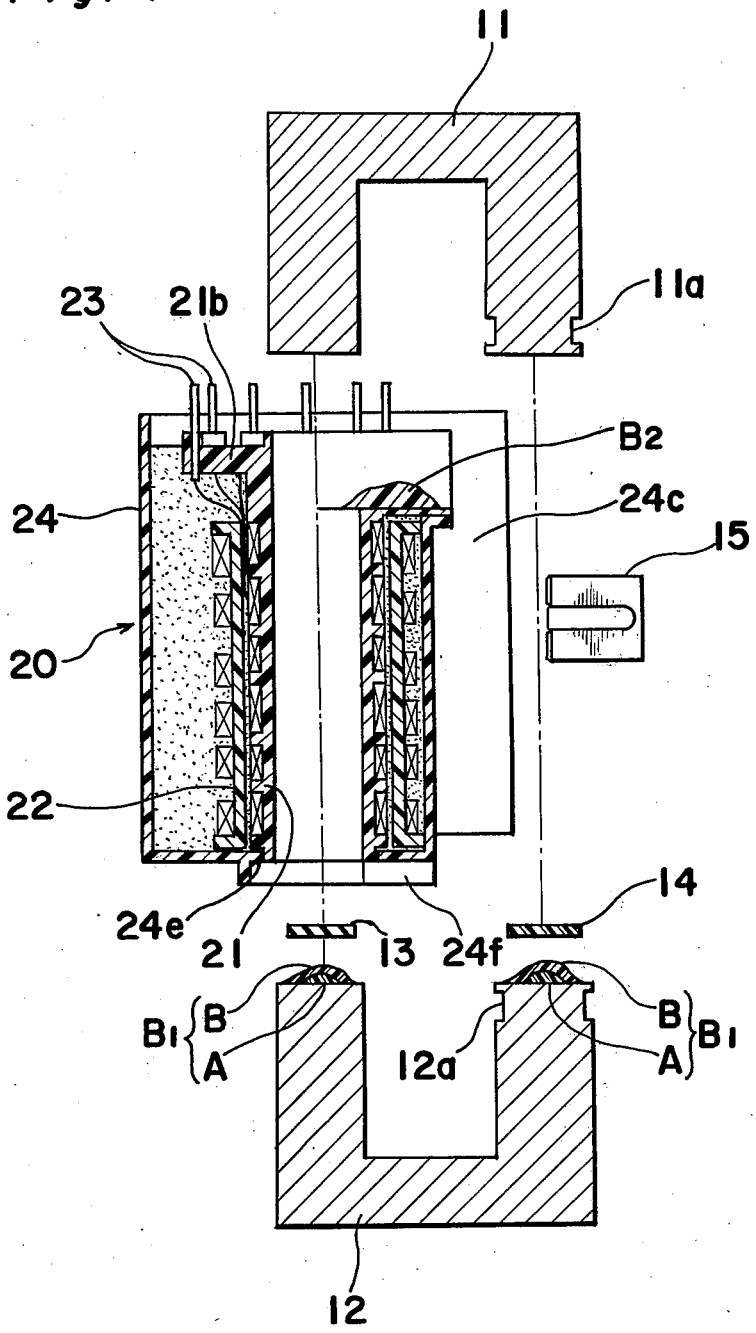
FIG. 7 is a cross-sectional view taken along a line VII—VII shown in FIG. 6.

First, an acrylic bonding agent B1 of two-component quick hardening type, that is a bonding agent which can be immediately hardened when the two components are mixed, is deposited, as best shown in FIG. 7, over the end face of each of the leg portions of one U-shaped member, e.g., 12 in such a manner that the two components A (0.05 g) and B (0.05 g) are placed one over the other. For the bonding agent B1, it is preferable to use an acrylic bonding agent, e.g., Cemedine Y-352 A, B (registered trademark of Cemedine Co., Ltd., Japan). Then, the spacers 13 and 14 are placed over the bonding agent B1 mounted on the end faces of the leg portions, respectively. The bonding agent B1 can be further deposited on the end face of each of the leg portions of the other U-shaped member 11 in a similar manner.

In the meantime, about 0.5 g of another bonding agent B2 of rubber type having some resiliency with high resistance to moisture is deposited on the bottom of the gutter 21*a* of the inner bobbin 21. For the bonding agent B2, it is preferable to use a bonding agent containing chloroprene rubber as a main ingredient, e.g., Diabond No. 1600 (registered trademark of Nogawa Chemical Co., Ltd., Japan) or an epoxy bonding agent, e.g., Araldite Clean Cast HF (registered trademark of Ciba-Geigy Japan Ltd.).

Then, one leg portion of the U-shaped member 11, which is not formed with the groove 11*a*, is inserted into the cylindrical bore of the inner bobbin 21 from the end of the bobbin 21 formed with the gutter 21*a* until the bridge portion of the U-shaped member 11 locates in the gutter 21*a*. Thereafter, one leg portion of the other U-shaped member 12, which is not formed with the groove 12*a*, is inserted into the cylindrical bore of the inner bobbin 21 from the other end of the casing 24 formed with the opening 24*e* until the bridge portion of the U-shaped member 12 locates in the groove formed by the wall 24*f*. The steps for inserting the leg portions of the U-shaped members 11 and 12 into the bore of the inner bobbin 21 can be opposite to that described above. In either cases, the insertion of the leg portions of the U-shaped members 11 and 12 should be carried out within 1 minute from the time when the bonding agent B1 is applied.

When inserting the U-shaped member 11, the member 11 should be pushed hardly against the gutter 21*a* to spread the bonding agent B2 in the gutter 21*a* around the inner wall of the gutter 21*a* and also around the inner cylindrical surface of the bobbin 21.

Since the total length of the leg portions of the core members 11 and 12 inserted in the cylindrical bore of the bobbin 21 is slightly longer than the length of the cylindrical bore of the bobbin 21, the full insertion of the leg portions results in a contact between the end face of the inserted leg portion of the U-shaped member 11 and the face of the spacer 13 mounted on the end face of the inserted leg portion of the U-shaped member 12. When the above mentioned contact, referred to as a first contact, takes place, the end face of the other leg portion of the U-shaped member 11 and the face of the spacer 14 mounted on the end face of the other leg portion of the U-shaped member 12 can be contacted with each other. This contact is referred to as a second contact, in contrast to the first contact. When the second contact takes place, the holder ring 15 is mounted on the end portions of the right-hand leg portions of the U-shaped members 11 and 12 of FIG. 7 to meet the centers of the corresponding leg portions.

When the first and second contacts are effected, the holder ring 15 is mounted to temporarily hold the ends of the U-shaped members 11 and 12, so as to match the centers of respective ends of the members 11 and 12. Then, the U-shaped members 11 and 12 are pushed towards each other with a pressing force of about 2 kg for 5 minutes by a suitable pressing means to mix the components A and B of the bonding agent B1 and also to squeeze out the mixed bonding agent B1 around the perimeter of the respective spacers 13 and 14. Since the diameter of each of the spacers 13 and 14 is smaller than that of the leg portion of the respective U-shaped members 11 and 12, the squeezed bonding agent B1 can be filled in a space between the end faces of opposing leg portions.

Figure 4:
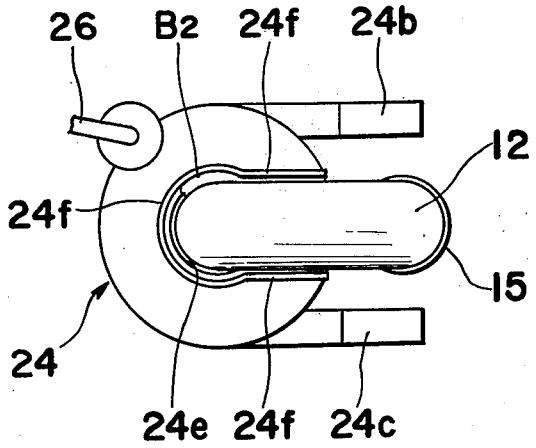
FIG. 4 is a bottom plan view of the flyback transformer of FIG. 2.

In a few seconds thereafter, a space between the bridge portion of the U-shaped member 12 and the wall 24*f* of the casing 24 is filled in with about 0.5 g of the bonding agent B2, i.e., the bonding agent of the same type as that deposited on the gutter 21*a*, to secure the rigid contact between the core unit 10 and the coaxial coil unit 20. FIG. 4 shows a condition in which the bonding agent B2 is partly applied to the space between the wall 24*f* and the U-shaped member 12. The applied bonding agent B2 should be first hardened at a room temperature so as not to produce any blowing in the bonding agent B2. Then, when the agent B2 is hardened to a degree which would not produce any blowing, it should be further hardened at a high temperature.

In order to further strengthen the above mentioned second contact, a third type of bonding agent B3 (FIG. 3) having a high permeability is deposited in contacting faces between the holder ring 15 and the corresponding leg portions. For the bonding agent B3, it is preferable to use a quick hardening acrylic bonding agent, e.g., Cemedine Y-300 (registered trademark of Cemedine Co., Ltd., Japan).

After a number of breakdown tests, it has been found that the arrangement of the flyback transformer of the present invention, particularly the contact between the U-shaped members 11 and 12 may not break even when it is disposed under severe conditions. A device used for the tests is a Universal tension tester of Aikho Engineering Co., Ltd., Japan which provides a tension to the U-shaped members 11 and 12 in a direction away from each other. FIG. 8 shows a result of the test when only the bonding agent B1 is applied. Five test pieces, each having core diameter 13 mm, spacer (made of nylon 11) diameter 8 mm, and spacer thickness 0.5 mm, were used in the tests. The first test is to measure the breakdown point of the core unit 10 immediately after the applied bonding agent B1 reaches a stable condition. The result of this test is given in the first row of the chart named as "Initial value". As apparent from the chart, the minimum breakdown point in this test is 70.0 kg obtained by the first test piece while the average breakdown point in this test is 80.70 kg. In other words, the core unit 10 can endure at least 70 kg tension immediately after the assembly is completed.

The second test is to measure the breakdown point of the core unit 10 after 1000 hours disposed at 120° C. The result of this test is given in the second row of the chart named "Thermal durability (at 120° C. for 1000 hrs.)".

The third test is to measure the breakdown point of the core unit 10 after 1000 hours disposed at −40° C. The result is given in the third row named "Thermal durability (at −40° C. for 1000 hrs.)".

The fourth test is to measure the breakdown point of the core unit 10 after 1000 hours disposed at 40° C. with the humidity of 90%. The result is given in the fourth row named "Moisture durability (at 40° C., 90% humidity for 100 hrs.)".

The last test is to measure the breakdown point of the core unit 10 when the flyback transformer of the present invention is alternately disposed at −40° C. for 2 hrs. and 120° C. for 2 hrs., repeatedly 20 cycles. The result is given in the fifth row named "Thermal durability (alternately in −40° C. for 2 hrs. and 120° C. for 2 hrs.)".

In order to provide a high quality flyback transformer, the breakdown point should be higher than 20 kg. From this standpoint, it is understood that the bonding agent B1 provides, even under a severe condition, sufficient strong adhesion between the core members 11 and 12.

Similar tests are carried out when the bonding agents B1, B2 and B3 are applied. When the three bonding agents B1, B2 and B3 are applied to the flyback transformer of the present invention, all the test pieces endured the tension of 150 kg under various severe conditions. Therefore, as apparent from the chart of FIG. 9, the breakdown point of the core unit 10 is understood to be above 150 kg.

Since the bonding agent B2 has some degree of resiliency, the difference of thermal expansion between the core unit 10 and the coaxial coil unit 20 may not produce any strain in the flyback transformer. In other words, undesirably high shrinkage or expansion of the core unit caused by the temperature change with respect to the coaxial coil unit 20 can be absorbed by the resiliency of the bonding agent B2.

Since connecting means for connecting the U-shaped members 11 and 12 together requires only the bonding agents B1, B2 and B3 and the holder ring 15, the manufacturing cost necessary for the connecting means can be cut down to about 19% when compared with the conventional connecting means which requires the frame bar 6, support plate 7 and nuts 8*a* and 8*b*.

Furthermore, the time required to assemble the flyback transformer of the present invention can be shortened to about 160 seconds, whereas that required to assemble the conventional flyback transformer takes about 200 seconds.

In addition to above, since no frame unit is employed for the connecting means, no sparking discharge is produced in the flyback transformer of the present invention. Therefore, the image produced on the screen of the cathode ray tube will not be deteriorated, and also the insulating material will not be deteriorated.

It is to be noted that the present invention can be applied not only to the flyback transformer but also to any other type of transformer, such as a choke transformer or a regulator transformer, so long as the core unit thereof is constituted by two or more ferrite core members.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of the appended claims.

What is claimed is:

1. A ferrite core type transformer which comprises:

a ferrite core unit comprising a first core member having first and second end faces, a second core member having first and second end faces, said first and second core members being positioned with respect to each other such that the first and second end faces of the first core member are aligned with the first and second end faces of said second core member thereby forming a closed magnetic path, and a first bonding agent having a quick hardening property at room temperature, said first bonding agent being applied between the first end faces of the first and second core members, and also between the second end faces of the first and second core members for rigidly connecting the first and second core members together, each of said first and second core members having a U-shaped configuration such that, when the first and second core members have been connected together, said core unit has a generally O-shape;

a coil unit comprising an inner bobbin for supporting a primary winding therearound, said inner bobbin having a bore therein for receiving said ferrite core unit, an outer bobbin for supporting a secondary winding therearound, said outer bobbin being arranged coaxially with said inner bobbin, a casing for housing said inner and outer bobbins therein and including guide means for receiving a portion of said core unit, and a thermosetting plastic filled in said casing;

a second bonding agent having a resiliency, said second bonding agent being positioned in said guide means between said guide means and one of said core members for bonding said coil unit and said core unit, the connection between the first end faces of the first and second core members being located outside the coil unit; and a holder means for engaging said first and second core members and holding the first and second core members together at the area of connection between the first end faces of the first and second core members.

2. A ferrite core type transformer as claimed in claim 1, further comprising first and second spacer means positioned between the first end faces of the first and second core members, and between the second end faces of the first and second core members, respectively.

3. A ferrite core type transformer as claimed in claim 1, wherein said holder means comprises a base portion and resilient bifurcated arms extending from the base portion, said bifurcated arms being curved along the length thereof, whereby a portion of said base portion and one of said bifurcated arms hold a portion of said first core member adjacent its first end face, and a portion of said base portion and the other of said bifurcated arms hold a portion of said second core member adjacent its second end face.

4. A ferrite core type transformer as claimed in claim 3, wherein an end portion of each of the bifurcated arms remote from the base portion and an end portion of the base portion remote from the bifurcated arms are curved outwardly away from each other.

5. A ferrite core type transformer as claimed in claim 3, further comprising a third bonding agent having a high permeability applied in contacting faces between the holder means and the core unit.

6. A ferrite core type transformer as claimed in claim 1, wherein said first bonding agent is an acrylic type.

7. A ferrite core type transformer as claimed in claim 1, wherein said first bonding agent is a two-component type.

* * * * *